US008794223B2

(12) United States Patent
Harris

(10) Patent No.: US 8,794,223 B2
(45) Date of Patent: Aug. 5, 2014

(54) LAMINATED POCKET SLINGSHOT WITH METAL CORE

(76) Inventor: James E Harris, Independence, KY (US)

( * ) Notice: Subject to any disclaimer, the term of this patent is extended or adjusted under 35 U.S.C. 154(b) by 124 days.

(21) Appl. No.: 13/464,988

(22) Filed: May 6, 2012

(65) Prior Publication Data

US 2012/0279482 A1 Nov. 8, 2012

Related U.S. Application Data

(60) Provisional application No. 61/483,184, filed on May 6, 2011.

(51) Int. Cl.
*F41B 3/02* (2006.01)
*F41B 3/00* (2006.01)

(52) U.S. Cl.
CPC ..... *F41B 3/02* (2013.01)
USPC ..... 124/20.1; 124/20.2; 124/20.3

(58) Field of Classification Search
CPC ..... F41B 3/02
USPC ..... 124/20.1, 20.2, 20.3
See application file for complete search history.

(56) References Cited

U.S. PATENT DOCUMENTS 257,379 A * 5/1882 Pohlman et al. ..... 124/20.1
1,207,025 A * 12/1916 Grigsby ..... 124/20.1
1,730,820 A * 10/1929 Holden ..... 16/431
2,585,663 A * 2/1952 Richard ..... 124/20.1
2,600,524 A * 6/1952 Fernsel ..... 124/20.1
2,625,925 A * 1/1953 Osborne ..... 124/20.2
2,995,129 A * 8/1961 Malott ..... 124/20.1
2,996,060 A * 8/1961 Appleby ..... 124/41.1
3,099,256 A * 7/1963 Halverson ..... 124/20.3
3,101,704 A * 8/1963 McCormick ..... 124/20.1
3,407,798 A * 10/1968 Rock ..... 124/20.2
3,494,346 A * 2/1970 Yount et al. ..... 124/20.1
3,618,585 A * 11/1971 Allison ..... 124/20.2
3,659,577 A * 5/1972 Richardson et al. ..... 124/88
3,865,094 A * 2/1975 Sweeney ..... 124/20.1
3,875,923 A * 4/1975 Horel ..... 124/20.1
3,901,209 A * 8/1975 Woolsey et al. ..... 124/20.1
3,923,034 A * 12/1975 Wolf ..... 124/20.1
4,133,333 A * 1/1979 Janssen ..... 124/20.1
4,198,949 A * 4/1980 Cook ..... 124/20.1
4,250,861 A * 2/1981 Ellenburg ..... 124/20.1
4,265,212 A * 5/1981 Wolf ..... 124/20.1
4,273,094 A * 6/1981 Hogan ..... 124/20.1
4,274,387 A * 6/1981 McBride ..... 124/20.2
4,307,699 A * 12/1981 Cuesta ..... 124/22
4,332,230 A * 6/1982 Lozier ..... 124/20.1
4,583,513 A * 4/1986 Ellenburg et al. ..... 124/20.2
4,722,316 A * 2/1988 Stinnett et al. ..... 124/20.1
4,922,884 A * 5/1990 Ford ..... 124/20.1
5,279,276 A * 1/1994 Nagel et al. ..... 124/20.1
5,579,750 A * 12/1996 Lease ..... 124/20.1
5,752,494 A * 5/1998 Tuller ..... 124/20.1
5,803,067 A * 9/1998 Ellenburg et al. ..... 124/20.1

(Continued)

*Primary Examiner* — Gene Kim
*Assistant Examiner* — Alexander Niconovich
(74) *Attorney, Agent, or Firm* — Thorpe North & Western LLP

(57) ABSTRACT

A layered composite slingshot having a metallic center or core, with overlaying spacing and outer layers. The individual layers are laminated together beginning with the metallic center. Pins are strategically inserted through the slingshot frame penetrating each layer, thereby locking each layer to one another.

17 Claims, 2 Drawing Sheets

(56) References Cited

U.S. PATENT DOCUMENTS

| | | | | |
|---|---|---|---|---|
| 5,894,672 | A * | 4/1999 | Ellenburg et al. | 33/265 |
| 6,786,213 | B1 * | 9/2004 | Lee | 124/20.1 |
| 6,968,835 | B2 * | 11/2005 | Lee | 124/20.1 |
| 7,059,314 | B1 * | 6/2006 | Teague | 124/20.3 |
| 7,506,642 | B2 * | 3/2009 | Edwards | 124/20.1 |
| 7,543,579 | B2 * | 6/2009 | Chang | 124/20.2 |
| 8,371,281 | B2 * | 2/2013 | Van Der Linden | 124/20.2 |
| 8,485,168 | B2 * | 7/2013 | Walterscheid | 124/20.1 |
| 2005/0172944 | A1 * | 8/2005 | Lee | 124/20.1 |
| 2008/0053421 | A1 * | 3/2008 | Chang | 124/45 |
| 2011/0232617 | A1 * | 9/2011 | Raymond | 124/20.1 |
| 2011/0277735 | A1 * | 11/2011 | Van Der Linden | 124/20.2 |

* cited by examiner

LAMINATED POCKET SLINGSHOT WITH METAL CORE

CROSS REFERENCE TO RELATED APPLICATIONS

This application claims the benefit of provisional patent application Ser. No. 61/483,184, filed 2011 May 6 by the present inventor.

FEDERALLY SPONSORED RESEARCH

Not Applicable

SEQUENCE LISTING OR PROGRAM

Not Applicable

FIELD OF THE INVENTION

The present invention relates to a slingshot device for propelling a projectile toward a target.

BACKGROUND

Prior Art

The manufacture of slingshots is an ancient art. The typical design of a conventional slingshot is one that has a handle and two upward extending arms. Attached to the upper tips or ends of the arms are elastic material. At the center of the elastic material is a means for holding or retaining an object to be propelled. A user of the device grasps the handle portion with one hand and pulls back the elastic material in the opposite direction of the target while securing the projectile between the elastic material or a pouch with two or more fingers of the other hand. While the elastic material is pulled back opposite of the target, the elastic material is placed in tension. When the user releases his grasp of the elastic material, the tension is released and the projectile is propelled toward the target.

Because of the stress that is placed upon the frame of the slingshot when the elastic material is stretched and released, it is imperative that the slingshot be constructed of a material that is capable of withstanding the stresses placed upon it. In addition, the construction of the slingshot and the material used must be capable of withstanding repeated use and operating conditions. For example, slingshots constructed entirely of wood, regardless of the species or hardness of the wood, suffer from the possibility that the frame will become fractured. This might occur when the arm of the slingshot is struck by the projectile, called a "fork hit", or when the slingshot is accidentally dropped onto a hard surface.

A slingshot constructed entirely of wood that contains a fracture, especially a fracture that lies concealed within the wood, poses a significant danger to the user and those nearby. Should the unseen fracture separate while the user pulls back on the elastic material, the frame could break apart and strike the user, or a bystander, with significant force.

Various attempts to improve the safety of slingshots are evident in prior art. But none of these attempts address slingshots constructed primarily of wood.

SUMMARY

In the current preferred embodiment of the present invention, a slingshot device is configured and constructed for propelling an object or projectile. The slingshot device is constructed of several layers consisting of a metal core, spacing layers, and outer layers. The slingshot is formed by laminating the different layers together to form a layered board. Layering these materials together creates a slingshot device that is stronger and performs better than traditional wood slingshots. The slingshot device is then cut from the layered board, wherein the slingshot frame consists of a user-graspable handle and two upward extending arms. Each of the first and second arms contain a slot, groove and/or hole defined in each that receives an elastic member, so that as the projectile body is grasped by the user and displaced rearward—i.e. pulled in the opposite direction of the target—the elastic members are retained in the grooves and/or holes. When the grasped projectile is then released by the user, the stored potential energy is converted to kinetic energy and the projectile is propelled toward the target.

DETAILED DESCRIPTION OF THE INVENTION

Figure 2:
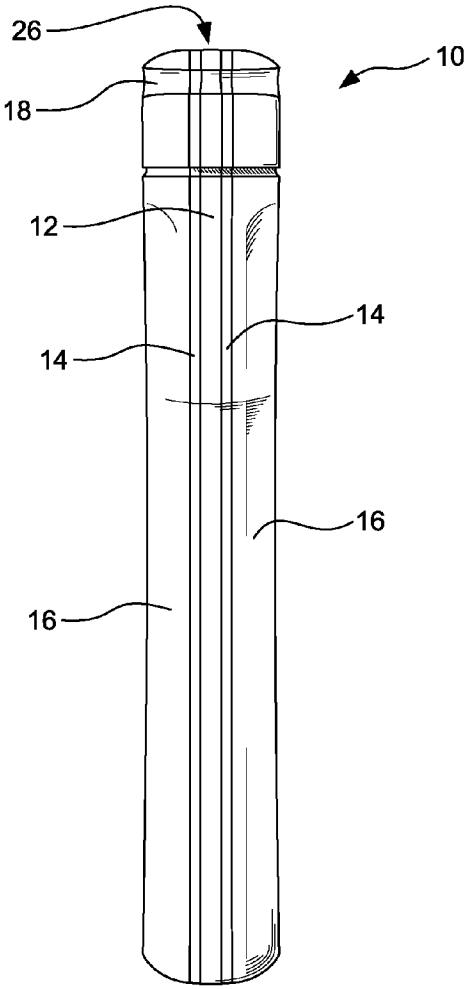
FIG. 2 is a side view of a preferred embodiment of a slingshot device constructed in accordance with the teachings of the present invention.

The present invention is directed to a slingshot device for selectively propelling an object or projectile in a predetermined and user-controllable direction toward a target. In its broadest sense, the invention provides the combination of a projectile and a hand-held launching device, in the general form of a slingshot, wherein the device itself includes no elastic means or members for propelling the projectile, but incorporates one or more elastic members for releasable engagement with the slingshot and which supplies the elastic energy for launching the projectile toward the target.

While the invention is susceptible to embodiments in many different forms, the preferred embodiments are shown in the drawings and described herein. It should be understood that the present disclosure is to be considered an exemplification of the principles of the invention and is not intended to limit the spirit or scope of the invention and/or claims of the embodiments illustrated.

Figure 1:
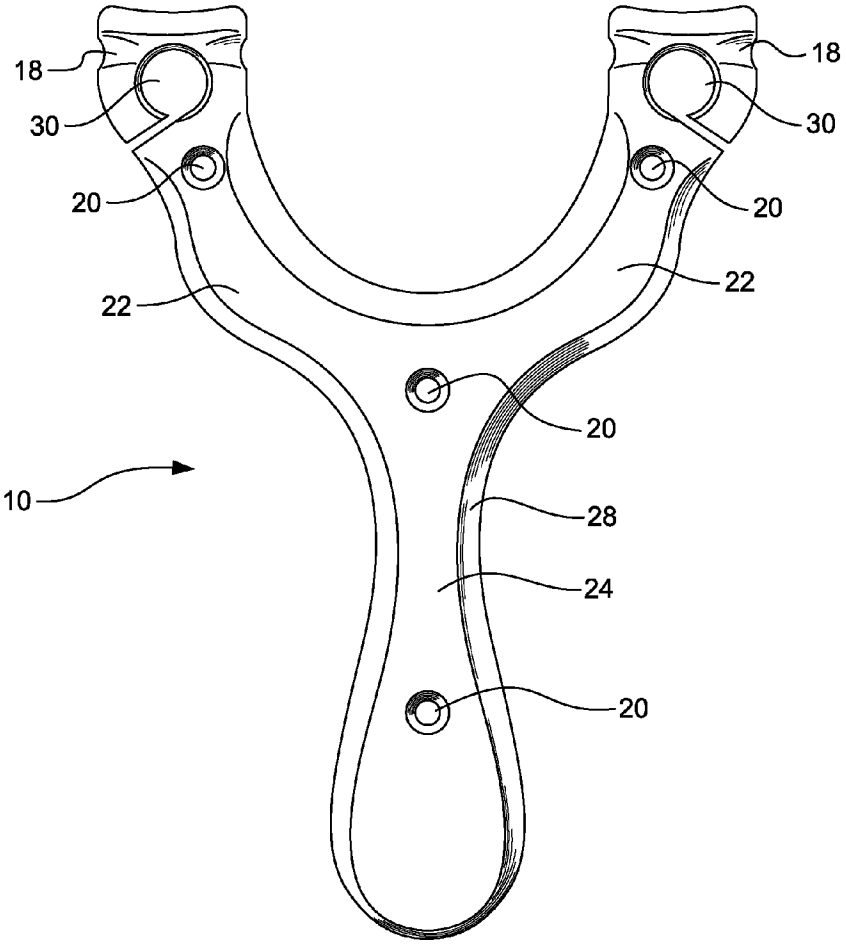
FIG. 1 is a front perspective view of a preferred embodiment of a slingshot device constructed in accordance with the teachings of the present invention.
Figure 3:
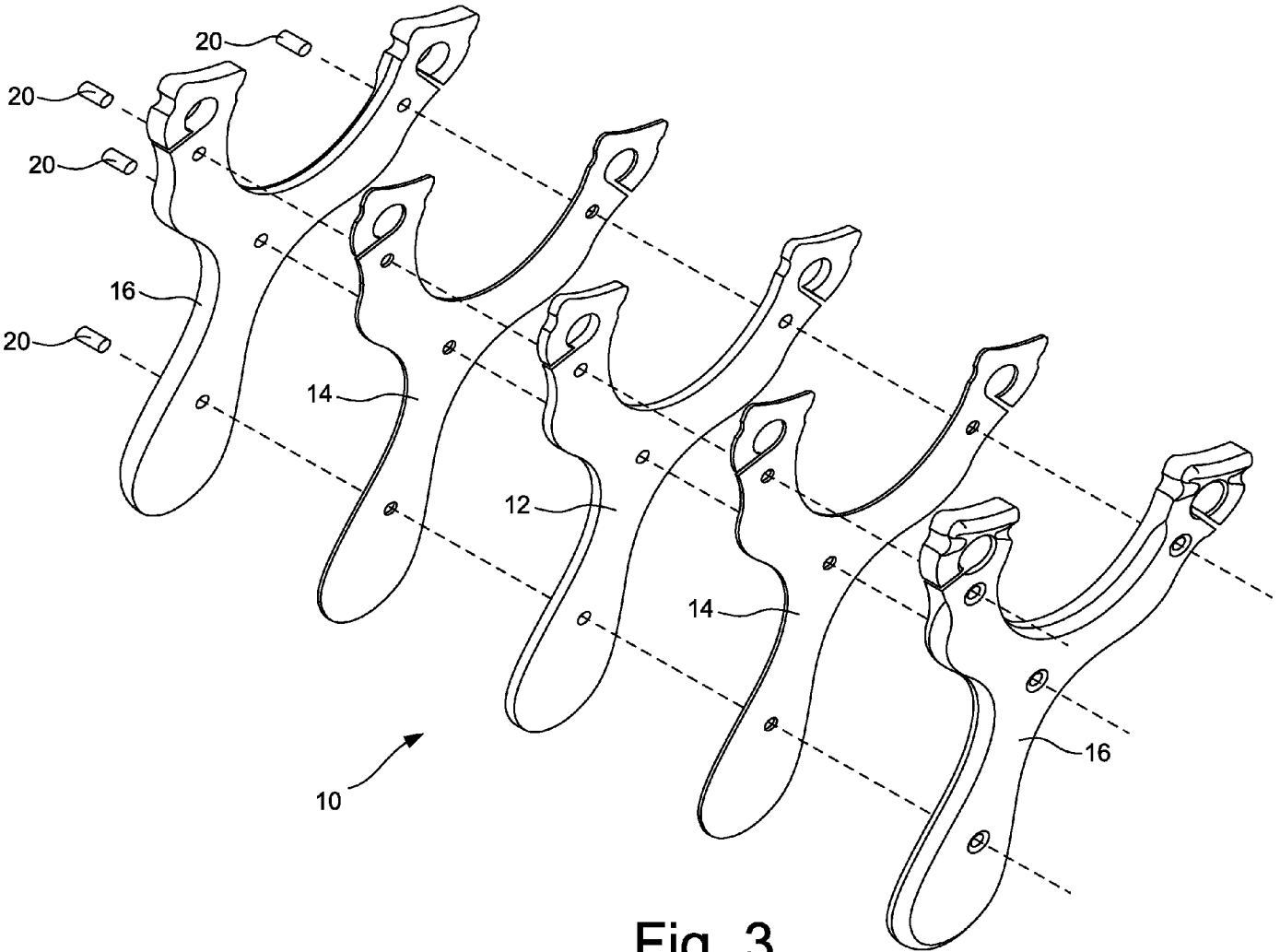
FIG. 3 is an exploded isometric view of a preferred embodiment of a slingshot device showing the metal core layer, spacing layers, outer layers, and pins.

In a preferred embodiment of the slingshot device, as is illustrated in FIGS. 1, 2, and 3; the slingshot device 10 is comprised of four primary components: a metal core 12, spacing material 14, outer layer material 16, and a plurality of tubular pins 20. The assembled device comprises a handle 24, having a pair of spaced arms 22 with annular grooves 18 and/or holes 30 adjacent to the upper ends of the arms 22 to which conventional slingshot elastic or bands may be secured.

The metal core 12 of the preferred embodiment is constructed of stainless steel or aluminum in flat sheet form being ⅛" thick that is lightly scored on each side by using an abrasive. Because of stainless steel and aluminum's qualities of strength and resistance to corrosion, and aluminum's quality of being light weight, these metals are specified in this preferred embodiment. It should be noted that any metal or metal alloy that provides sufficient strength under the repeated stress of use, having a thickness between 0.060" and 0.5", may be used in forming the metal core 12 of the slingshot device 10. The advantage of a slingshot with a metal core is evident when considering that slingshots composed entirely of wood or plastic cause a greater amount of shock to be transmitted to the shooters hand and wrist. This shock together with the pull required to propel a projectile from the device increases fatigue experienced by the shooter and thereby decreases the shooters accuracy. A metal core absorbs the shock normally transmitted through the handle of the device to the shooters hand and wrist. Additionally, a metal core provides stability and integrity to the slingshot device and allows for greater control as the weight of the metal core reduces recoil compared to a slingshot composed entirely of wood or plastic that is equal in size. Whereas on the other hand, a device composed entirely of metal increases the weight of the slingshot which has the effect of causing fatigue to the arms and shoulders of the shooter.

A sheet of spacing material 14 constructed of glass-reinforced epoxy laminate that is 0.060" in thickness is laminated to both sides of the metal core 12 layer using a polyurethane epoxy adhesive. The spacing material 14 is clamped to the metal core 12 layer and allowed to cure for twenty-four hours. The spacing material 14 may consist of one of a number of materials and thicknesses, including but not limited to; fiber glass, thermoplastic sheet, or thermoset composite. Because expansion and contraction takes place at different rates in the metal core 12 and the outer layer material 16, the spacing material 14 acts as an expansion joint to keep the outer layer material 16 stabilized and prevents cracking under conditions of expansion and contraction. Due to its ability to bond to adhesives, the material used as a spacing layer adds additional strength between the metal core 12 and outer layer material 16 of the slingshot device 10. In addition, the spacing material 14 aids in gaining overall thickness to the body of the slingshot device 10 without adding unwanted weight.

A finish outer layer material 16 composed of wood board that is ¼" in thickness is laminated to each exposed side of the spacing material 14 from the previous step. The interior side of the outer layer material 16 is lightly scored using an abrasive. The scored side of the outer layer material 16 is then laminated to the exposed side of the spacing material 14 using a polyurethane epoxy adhesive. Clamps are used to secure the outer layer material 16 to the interior layers 26 and allowed to cure for twenty four hours. The outer layer material 16 provides additional strength and substance to the device without substantially increasing the overall weight of the slingshot device 10. Although ¼" wood board of any species is disclosed as the outer layer material 16 of the preferred embodiment, any material of any reasonable thickness possessing similar qualities of strength, weight and durability may be substituted.

After all layers have cured, a water jet cutter or a similar means that protects the metal core 12 from excessive heat during the cutting process is used to cut the frame of the slingshot device 10 from the layered board produced in the previous steps. The edges 28 of the slingshot device 10 frame are routed and smoothed. Grooves 18 are filed into each arm 22 of the slingshot device 10 to accommodate elastic bands.

Pins 20 are strategically placed into the slingshot device 10 by drilling four 3/16" holes through each of the slingshot device 10 frame layers. Drilling is done at low revolutions per minute to prevent work hardening of the metal core 12. Said pins 20 are 3/16" in diameter and may be tubular or solid. The pins 20 may be, but are not limited to, those manufactured from stainless steel, copper, brass or aluminum. The pins 20 are inserted near the top of each arm 22, in the middle of the slingshot device 10 frame, and one near the bottom of the handle 24, locking each of the layers to one another vertically. Each pin 20 contains five channels that run horizontally along the outside surface of the pin 20. These channels provide a provision for an epoxy adhesive; hence when the pin 20 is inserted through the layers of the slingshot device 10 frame, a bond is created between the pin 20 and the different layers.

Thus it can be seen that at least one embodiment of the slingshot device 10 provides for a stronger, safer and better performing slingshot. While the above description contains many specificities, these should not be construed as limitations on the scope, but rather as an exemplification of one preferred embodiment thereof. Many other variations and materials are possible. Accordingly, the scope should be determined not by the embodiments illustrated, but by the appended claims and their legal equivalents.

ADVANTAGES

From the description above, a number of advantages of the embodiments of this invention become evident:

a) The safety of the traditional wood slingshot is enhanced while keeping the manufacturing process simple and low cost.

b) Shooting performance is improved as the additional weight of the metal core reduces the effects of recoil.

c) Durability of the traditional wood slingshot is enhanced making it more resistant to impact damage and breakage when stowed away by its user.

What is claimed is:

1. A slingshot comprising:

a handle with two spaced arms, having a. a metallic core having a handle portion and two arm portions;

b. and two overlaying outer layers that substantially correspond to a shape and size of said handle portion and said two arm portions of said metallic core, wherein each side of said metallic core receives one of said overlaying outer layers affixed to said metallic core substantially covering each facing side of said metallic core, whereby said metallic core and said two overlaying outer layers form a unitary structure capable of withstanding stresses associated with use of said slingshot, the metallic core providing central strength and shock absorption, and said two overlaying outer layers providing supporting strength to said metallic core.

2. The slingshot of claim 1, wherein a spacing layer is placed between said metallic core and each of said overlaying outer layers.

3. The slingshot of claim 2, wherein a plurality of pins are inserted through said overlaying outer layers, said spacing layers and said metallic core, whereby said overlaying outer layers are locked to said spacing layers and said metallic core.

4. The slingshot of claim 1, wherein said metallic core is cut from a flat metal sheet.

5. The slingshot of claim 4, wherein said flat metal sheet is composed of stainless steel or aluminum.

6. The slingshot of claim 4, wherein said flat metal sheet has a thickness between 0.060" and 0.5".

7. The slingshot of claim 4, wherein said metallic core is cut from said flat metal sheet using a water jet cutter.

8. The slingshot of claim 1, wherein said two overlaying outer layers are composed of wood.

9. The slingshot of claim 1, wherein said two overlaying outer layers are composed of a synthetic composite material.

10. The slingshot of claim 1, wherein interior sides of said two overlaying outer layers are scored with an abrasive creating additional surface area to affix to an adjoining element.

11. The slingshot of claim 1, further comprising laminating said two overlaying outer layers to said metallic core.

12. The slingshot of claim 1, further comprising cutting grooves into said two spaced arms to accommodate elastic bands.

13. The slingshot of claim 2, wherein said spacing layer is composed of fiber glass, thermoplastic sheet or thermoset composite.

14. The slingshot of claim 2, further comprising laminating said spacing layer to said metallic core and laminating one of said overlaying outer layers to said spacing layer.

15. The slingshot of claim 3, wherein said plurality of pins are constructed from stainless steel, copper, brass or aluminum.

16. The slingshot of claim 3, wherein said plurality of pins have a hollow center.

17. The slingshot of claim 3, wherein said plurality of pins contain a plurality of channels that run horizontally along the outside vertical surface of said plurality of pins.

* * * * *